US006773076B1

(12) United States Patent
Weihrauch

(10) Patent No.: US 6,773,076 B1
(45) Date of Patent: Aug. 10, 2004

(54) METHOD OF MECHANICALLY SPLITTING BRISTLES

(75) Inventor: Georg Weihrauch, Wald-Michelbach (DE)

(73) Assignee: Pedex & Co. GmbH, Wald-Michelbach (DE)

( * ) Notice: Subject to any disclaimer, the term of this patent is extended or adjusted under 35 U.S.C. 154(b) by 0 days.

(21) Appl. No.: 09/959,389

(22) PCT Filed: Apr. 12, 2000

(86) PCT No.: PCT/EP00/03250

§ 371 (c)(1),
(2), (4) Date: Oct. 24, 2001

(87) PCT Pub. No.: WO00/64308

PCT Pub. Date: Nov. 2, 2000

(30) Foreign Application Priority Data

Apr. 27, 1999 (DE) ..... 199 18 959

(51) Int. Cl.[7] ..... A46D 1/05
(52) U.S. Cl. ..... 300/21; 300/17
(58) Field of Search ..... 15/167.1, 207.2, 15/DIG. 5, DIG. 6; 300/2, 17, 21

(56) References Cited

U.S. PATENT DOCUMENTS

| | | | | |
|---|---|---|---|---|
| 2,812,530 A | | 11/1957 | Whitesel | |
| 3,013,364 A | | 12/1961 | Hovorka | |
| 3,233,943 A | | 2/1966 | Peterson | |
| 3,295,156 A | * | 1/1967 | Brant | 15/167.1 |
| 4,756,044 A | * | 7/1988 | Clark | 15/207.2 |
| 5,791,740 A | | 8/1998 | Squillaci | |

FOREIGN PATENT DOCUMENTS

| | | |
|---|---|---|
| DE | 1 175 199 | 2/1965 |
| DE | 1 997 717 | 12/1968 |
| DE | 94 08 268 | 8/1994 |
| DE | 44 25 231 | 3/1995 |
| DE | 43 39 040 | 5/1995 |
| DE | 44 41 985 | 5/1996 |
| DE | 195 28 834 | 2/1997 |
| DE | 297 13 087 | 10/1997 |
| DE | 197 28 493 | 2/1998 |
| DE | 197 48 733 | 5/1999 |
| EP | 0 736 270 | 10/1996 |
| GB | 750 509 | 6/1956 |
| WO | WO 97 25 902 | 7/1997 |
| WO | WO 98 38 889 | 9/1998 |
| WO | WO 98 48 086 | 10/1998 |

* cited by examiner

*Primary Examiner*—Theresa T. Snider
(74) *Attorney, Agent, or Firm*—Paul Vincent

(57) ABSTRACT

During processing of bristles, at least some bristles of a bristle stock are split, along at least part of their length, into several separate partial cross-sections or fingers under the action of mechanical forces. For simplified manufacture of bristles with defined fingers independent of their relative disposition, the mechanical forces are applied from different directions with respect to the longitudinal axis of the bristles preferably using a blunt, blade-free tool, e.g. a striking tool.

15 Claims, 4 Drawing Sheets

METHOD OF MECHANICALLY SPLITTING BRISTLES

BACKGROUND OF THE INVENTION

The invention concerns a method for the treatment of bristles at least some of which are split by mechanical forces into several separate partial cross-sections, at least along part of their length. The invention also concerns brushes comprising such bristles.

Most bristles for brushes of any kind, e.g. brushes for body and tooth care, household brushes, technical brushes, paint brushes etc. are currently produced from polymers by extruding molten polymer into endless monofilaments with subsequent drawing thereof and, optionally, stabilization of the monofilaments. The bristles are then produced from the monofilaments by cutting them to a suitable length. In general, the monofilaments and the bristles have a circular cross-section. For particular applications, bristles having a different cross-section, e.g. an oval or polygonal cross-section have been used, wherein a monofilament of corresponding profile is extruded.

In particular applications, it is desirable to use bristles whose useful ends have a fibrous, in particular, fibrillar structure, especially e.g. for brushes for applying media onto surfaces or the like, e.g. paint brushes. Even if a fleecy structure is desired, the bristle must be fibrillar. Recent findings in dental medicine have established that conventional tooth brush bristles are insufficient for cleaning, since they slide across and do not penetrate into the fine fissures of the tooth surface. A similar cleaning problem obtains for the interdental spaces.

Bristles have been split using a rotating cutter for obtaining highly fibrous structures at the bristle end U.S. 2, 812,530, WO 98/48086). When the bristles are made from polymer mixtures, the following effects are utilized: during extrusion and subsequent drawing of the monofilament, the polymer molecules are oriented in the longitudinal direction of the monofilament. The primary binding forces acting in the longitudinal direction provide high tensile strength. This orientation of the molecules in the longitudinal direction also generates the desired bending flexibility. With monofilaments produced from one individual polymer, the so-called secondary binding forces, i.e. the forces transverse to the molecular extension, are sufficiently great to prevent fraying out or splitting of the monofilament or the bristle. With monofilaments made from two different mixed polymers, sliding zones, in which the secondary binding forces area reduced, are generated between the molecular chains of the polymers during drawing. A monofilament of this type or a bristle produced therefrom can be split by mechanical forces using cutters or cutting tools. The so-called flags produced in this fashion have a highly irregular shape, irregular cross-sections, and frayed outer surfaces. A large bundle of such bristles has a fleecy, well absorbing structure. However, the individual flags have poorly defined mechanical properties. They tear off, break off or fold over. Bristles frayed out in this manner are unsatisfactory and even unsuitable for many applications. Their use in tooth brushes is questionable for hygienic reasons.

Further problems arise with brushes comprising both bristles whose ends are split and divided into flags as well as unsplit bristles. During splitting of the bristles, the sharp blades of the rotating cutter also interact with the bristles which are not intended to be split and can damage or cut their outer sides. Production of a bristle field comprising both split and unsplit bristles requires special procedures, since the cutter must not act on the unsplit bristles. A possible solution to this problem would be to separate the bristles not to be split from the bristles to be split before treatment by separation and/or covering (DE 197 28 493 A1; EP 0 736 270 A1). This process, however, is difficult and expensive. If the ends of the bristles which are not split are to be further treated, e.g. rounded, further separation of the respective bristles and an additional processing step are required.

WO 98/38889 discloses disposing the ends of the bristles to be split in a plane above the ends of the bristles not to be split by combining the bristles to be split and the ones not to be split into corresponding bristle bundles of different respective length. This permits retroactive splitting of the protruding ends of the bundles of bristles to be split. However, the lower lying ends of the unsplit bristles can only be reached for subsequent rounding through separation, which makes production difficult and expensive. Since the protruding split bristles are relatively thin, the split bristle ends may form mop-like heads even following a short period of use to prohibit proper brushing. In particular, the very fine fissures in the chewing surfaces of the teeth and also the interdental spaces cannot be reached in this fashion.

The essential disadvantage of splitting the ends of bristles, made from polymer mixtures, using a circulating cutter is that defined division of the bristles into predetermined partial cross-sections is thereby not possible. In addition, splitting generates some flags of very thin cross-section which can break during use and can be swallowed by the user of a tooth brush, which is detrimental to health.

Bristles have been proposed, in particular for tooth brushes, which are made from a plurality of thin fibers having a cover, enclosing the fibers (WO 97/25902; DE 9 408 268 U1). The cover and fibers can also be co-extruded as filaments. After cutting to the desired bristle length, the cover at the useful end of the bristle is removed by mechanical treatment or cutting to expose a short length of the fibers. These bristles are difficult to produce and have limited applications. A substantial disadvantage is, in particular, the abrupt change of the bending behavior at the transition: region between the fibers and the cover. If such bristles are used in application devices, the treated surface can be damaged by this hard transition. Similar effects obtain for use of such bristles in tooth brushes with respect to their effect on the teeth and the gums. Furthermore, the fibers virtually do not bend and cannot penetrate sufficiently into deeper depressions, interdental spaces or the like. The fibers also tend to break easily at the cover edge after prolonged use.

DE 1 997 717 U1 and DE 196 40 863 A1 each disclose a bristle made from several plastic fibers, which are connected to one another. According to DE 1 997 717 U1, the fibers are oriented parallel to one another and are welded at their contacting lines, with the bristle ends remaining unwelded. This is difficult to achieve from a technical point of view. Moreover, capillary spaces remain between the fibers in which contaminants and bacteria can accumulate. According to DE 196 40 863 A1, a number of fibers are twisted together, connected by chemical means and spliced at their ends,.wherein hollow spaces are also produced between the individual fibers in which bacteria can accumulate. Neither of the two processes permits retroactive splitting or splicing of bristles.

It is the underlying purpose of the invention to provide a method for the treatment of bristles with which bristles can be easily split into defined partial cross-sections irrespective of their respective arrangement and design. The invention also concerns production of a brush comprising such bristles.

This object is achieved in accordance with the invention in that the mechanical forces for splitting the splittable bristles are applied from different directions, relative to the longitudinal axis of the bristles. The method in accordance with the invention is preferably used in bristle fields comprising splittable and also non-splittable bristles. The effect of external mechanical forces from various directions permits, within a relatively short time, complete separation of the splittable bristles, in particular at the bristle ends, into their partial cross-sections, i.e. into fingers. The mechanical forces are preferably applied by at least one blunt tool, e.g. a striking tool. When this tool strikes the bristles not to be split, they are only laterally deflected without being damaged or cut. The bristles to be split and the bristles not to be split must not thereby be separated and splitting can be carried out in one processing step.

SUMMARY OF THE INVENTION

The method can be applied to bristles which are already mounted on a bristle support. However, the method can also be used with bristles which are packed into bristle bundles and are available in this form for subsequent further processing.

The striking tools must be designed such that the bristles are not cut. The striking tools can preferably be cutters having blunt, e.g. rounded blades. The applied striking energy overcomes the secondary binding forces of the bristles, dividing or splitting them into several fingers.

In the present invention, it is irrelevant if the ends of the bristles to be split and the ones not to be split are disposed in the same plane or if they are offset from one another, since the striking tools do not cause permanent deformation of the bristles which are not to be split. Moreover, this method does not depend on the bristle configuration, i.e. the bristles can be disposed either in groups, in bundles, as individual bristles or also as combinations of same. Since the bristles to be split are hit and split with high accuracy, while the bristles not to be split remain undamaged, the method in accordance with the invention effects, with high precision, a defined bristle field having a predetermined configuration of split and unsplit bristles. Since previous separation, dividing or covering of bristles is not required, the method can be carried out in a simple and inexpensive fashion.

In a preferred embodiment, the mechanical forces are applied intermittently using e.g. rotating fly cutters. The bristles are preferably oriented essentially parallel to one another and the mechanical forces are applied essentially radially with respect to the longitudinal axes of the respective bristles. Application of mechanical forces from various directions relative to the longitudinal axis of the bristles can be effected in embodiments of the invention by changing the position of the tool relative to the bristles to be treated by e.g. rotating the tool about the longitudinal bristle axis during treatment or by setting various positions about the longitudinal axis of the bristles. Alternatively or additionally, the bristles can be rotated about an axis extending parallel to their longitudinal axis, wherein the tool acts on the bristles from different external sides.

The bristle ends are normally split into the partial cross-sections or fingers through application of mechanical forces in the region of the free bristle end. Application of the mechanical forces in various axial sections of the bristles has turned out to be particularly effective for supporting the splitting.

Several tools, distributed about the circumference of the bristles, are preferably provided having different orientations relative to the bristles to be treated for splitting the bristles in a rapid and reliable fashion.

A preferred embodiment of the invention utilizes bristles which can be split into previously defined partial cross-sections. This can be achieved by forming the splittable bristles from two co-extruded polymers, in a geometrically uniform arrangement, with bordering layers extending essentially in the axial direction and having reduced secondary binding forces. The monofilament is preferably a matrix of the polymer determining the physical and chemical properties of the bristle, with the second polymer being embedded in the matrix in the form of thin layers.

Bristles and monofilaments of this kind are disclosed in the unpublished international patent application PCT/EP98/06954, filed by the applicant, the complete disclosure of which is hereby incorporated by reference in the present application. Reference is made here to this international patent application to avoid repetition of details. The individual fingers can preferably be made from polymer mixtures which can be re-split in a conventional subsequent method step: using rotating cutters.

As an alternative, the method in accordance with the invention can be used to split monofilaments or bristles, consisting of subsequently combined, extruded partial flows, which can therefore be split at their bordering surfaces. Bristles having several partial cross-sections which are connected to one another via bridges can also be split, wherein the bridges are broken up by application of mechanical forces or striking energy.

A further development- of the invention provides for further treatment of the bristle ends before, during or after application of the mechanical forces for splitting the bristles to be split, which can preferably include mechanical and/or thermal rounding of the bristle ends. Alternatively, the bristle ends can be tapered or roughened. Further treatment or rounding of the bristles can be effected in the same axial plane of the bristles in which the mechanical splitting forces are applied or in a different plane. In particular, the splittable bristles can be split and rounded in one operating step, whereas the non-splittable bristles are simultaneously rounded only. This advantageous embodiment can be effected when the ends of all bristles are disposed in one plane or envelope surface or when the planes of the splittable and non-splittable bristle ends differ.

A preferred embodiment of the invention provides for further treatment of the bristles and, in particular, rounding thereof as well as application of mechanical splitting forces using the same tool or tools. The tools must be suitable for rounding the ends of the bristles while also exerting intermittent striking forces on the bristles to be split. A corresponding tool would e.g. be a grinding wheel having a marked and preferably uniform surface profile.

A brush in accordance with the invention consists of a brush support and bristles mounted thereto wherein, in accordance with the above-mentioned method, at least some of the bristles are split into several separated partial cross-sections or fingers at least along part of their length through the action of mechanical forces. All bristles in the bristle stock of the bristle support can thereby be correspondingly treated and split. Alternatively, the bristles to be split can be restricted to a partial region of the bristle stock.

In a preferred embodiment of the invention, the split and the unsplit bristles are arranged alternately next to one another or non-splittable bristles or bristle elements are arranged between each of the bristle or bristle elements to be split. The bristle elements can be individual bristles, bristle bundles, bristle zones, or combinations thereof. An alternating arrangement of split and unsplit bristles can be provided within the bristle bundle or bristle zones. The non-splittable bristles define separations between the split bristles and provide support therefor. In this manner, the split ends of the split bristles do not impede each other during use of the brush in response to the brushing forces and, in particular, do not engage each other in a mop-like fashion.

The ends of the split bristles and the ends of the unsplit bristles of the brushes can be disposed in the same envelope surface or plane or in different envelope surfaces or planes. The individual fingers of the split bristles can also be slit and divided into partial cross-sections.

Further details and features of the invention can be extracted from the following description of embodiments with reference to the drawings.

DESCRIPTION OF THE PREFERRED EMBODIMENT

Figure 1A:
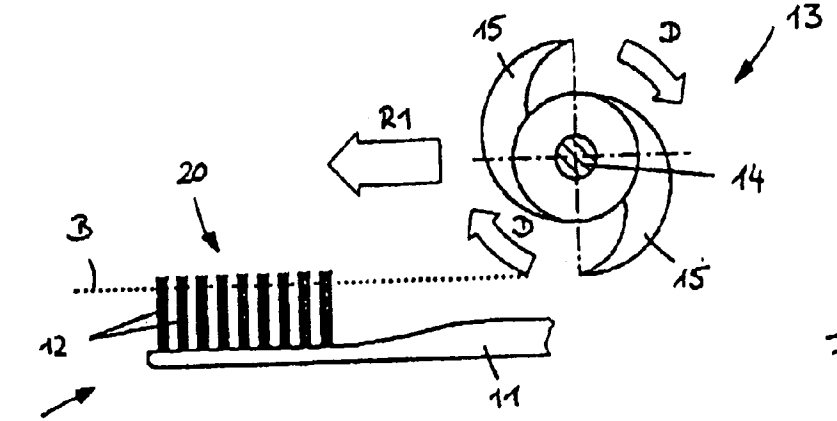
FIG. 1A shows a side view of a first embodiment of a device for carrying out the method in accordance with the invention.
Figure 1B:
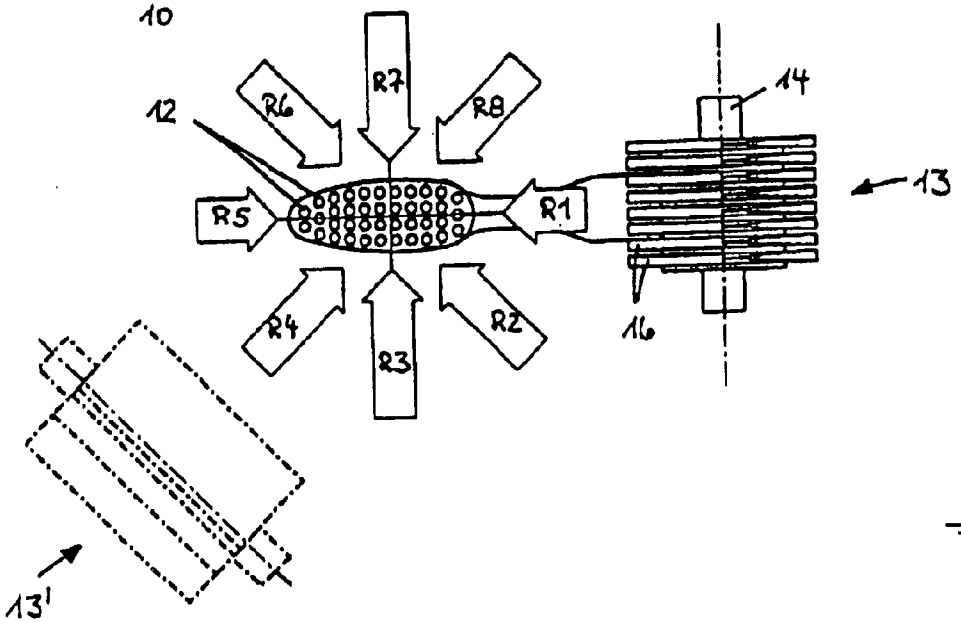
FIG. 1B shows a top view of the first embodiment of a device for carrying out the method in accordance with the invention.

FIGS. 1A and 1B show a first embodiment of a device for carrying out the method in accordance with the invention. By way of example, the brush thereby shown is a tooth brush 10 comprising a brush support 11, whose front head is provided with a bristle field 20 comprising a plurality of bristles 12 projecting vertically upwards and oriented essentially parallel to each other. The bristles 12 can be combined into bundles and/or be individual bristles.

An external mechanical force can be exercised on the free ends of the bristles 12 using a circulating striking device 13. The striking device 13 comprises a shaft 14, extending essentially perpendicular to the longitudinal axis of the bristles 12, on which several parallel striking wheels 16 are, mounted, each comprising two diametrically disposed crescent-shaped striking cutters 15 which are blunt and e.g. rounded and which do not cut but merely strike the bristles 12. The shaft 14 is rotatably driven together with the cutting wheels 16 (in a manner not shown) in the direction of the arrows D.

The striking device 13 is guided in direction R1 over the bristle field 20 formed by the bristles 12 such that the rotating striking cutters 15 exert an essentially radial striking force on the free ends of the bristles 12 to thereby split the free ends of the bristles 12 into several separate partial cross-sections or fingers, if the bristles are made from a splittable material.

As shown in FIG. 1B, the striking device 13 is not only guided over the bristle field 20 in the direction R1. In this embodiment, eight effective working directions; R1 to R8, are provided which are displaced by 45° with respect to another about a vertical axis, i.e. parallel to the longitudinal axis of the bristles 12. The striking device 13 acts on the bristles 12 from these directions. The different directions R1 to R8 can be effected by changing the position of the striking tool relative to the bristles through adjustment about a vertical axis parallel to the longitudinal axes of the bristles. Relative or in addition thereto, the brush 10 can also be turned about a vertical axis extending parallel to the longitudinal axes of the bristles. Several striking devices 13 with different working directions can also be disposed to exercise striking forces on the bristles from various directions. A further striking device 13 with a different orientation relative to the brush 10 for exerting striking forces in the effective direction R4 is shown in dash-dotted lines in FIG. 1B.

Figure 2A:
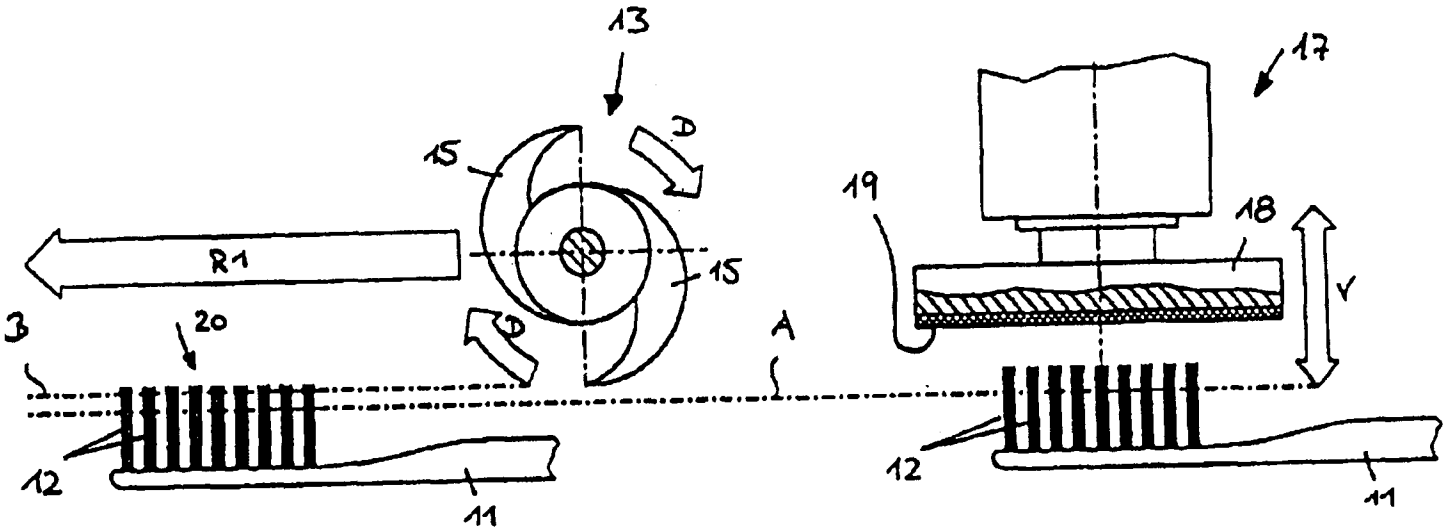
FIG. 2A shows a side view of an alternative embodiment of a device for carrying out the method in accordance with the invention.
Figure 2B:
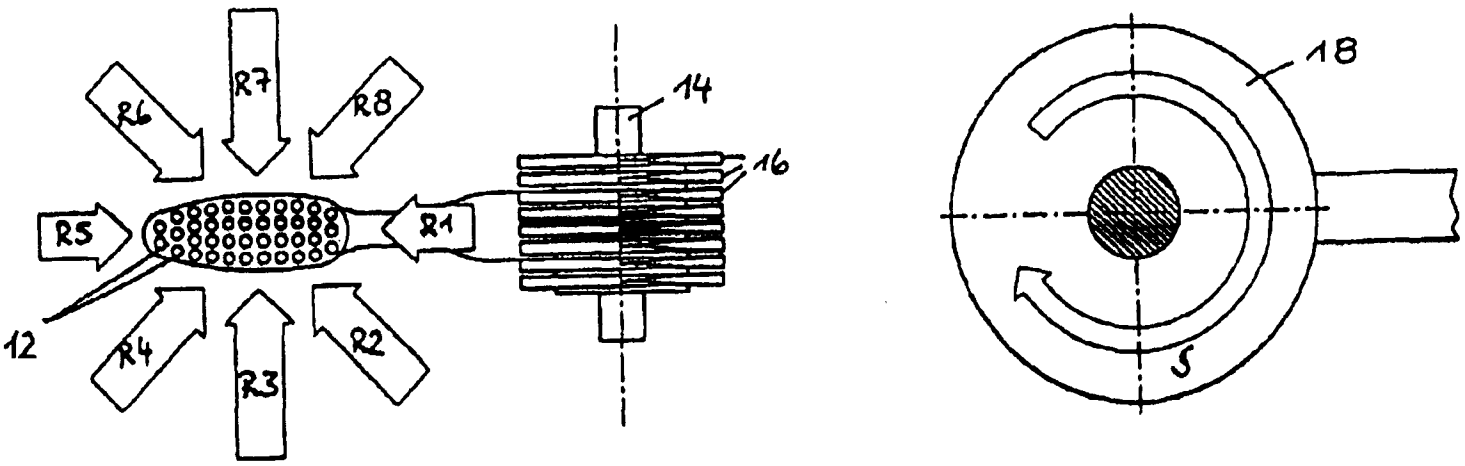
FIG. 2B shows a top view of the alternative embodiment of a device for carrying but the method in accordance with the invention.

FIGS. 2A and 2B show a further development of the device according to FIGS. 1A and 1B, wherein, in addition to the striking device 13, a grinding device 17 is provided which rotates about a vertical axis and which comprises a grinding wheel 18 extending essentially parallel to the surface of the brush field 20 and having a grinding layer 19 at its lower side. The grinding layer can be adjusted in the vertical direction (arrow V) such that the grinding layer 19 abuts the free ends of the bristles 12 of the bristle stock 20 and rounds same. The position of the working plane A, i.e. the extent to which the grinding tool 17 is lowered onto the bristle field 20, can thereby be adjusted.

The bristle ends of the splittable bristles can be split before or after rounding of the bristles 12 via striking forces exerted by the striking device 13 on the free ends of the bristles 12 from various radial directions R1 to R8. The striking device 13 thereby acts on the bristles up to a working plane B, i.e. up to a predetermined separation from the free ends of the bristles. The working planes A and B may be different (as shown in FIG. 2A) or can also coincide.

Figure 3A:
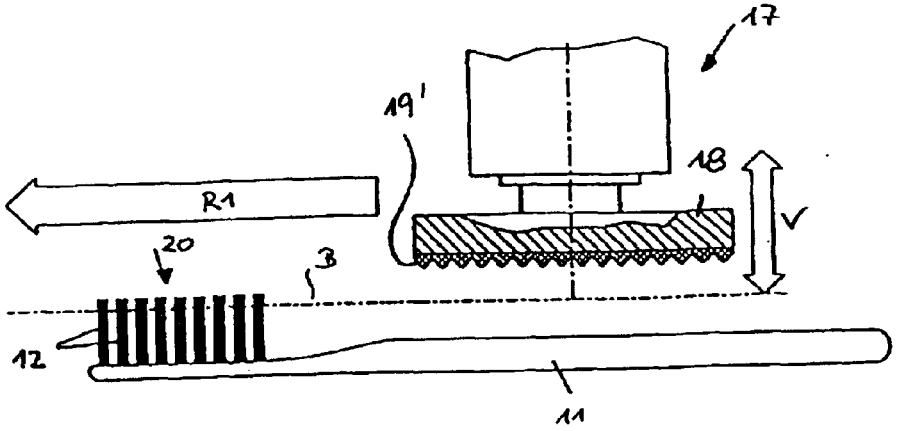
FIG. 3A shows a side view of a further embodiment of a device for carrying out the method in accordance with the invention.
Figure 3B:
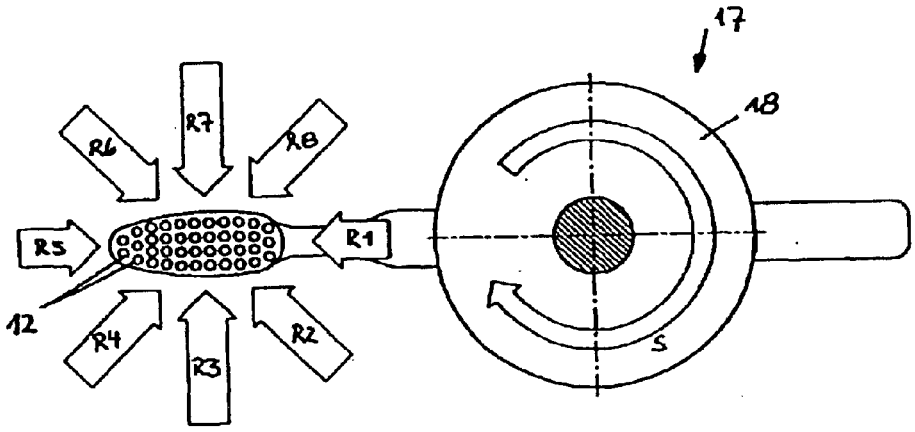
FIG. 3B shows a top view of the further embodiment of a device for carrying out the method in accordance with the invention.

FIGS. 3A and 3B show a device for simultaneous splitting and rounding of the bristle ends.

Figure 4:
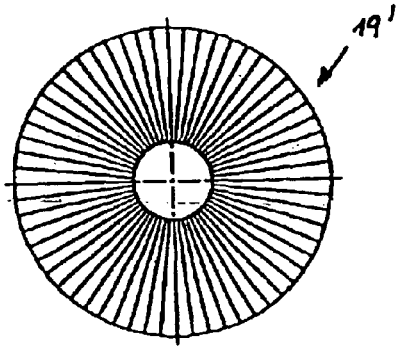
FIG. 4 shows a view of the tool according to FIG. 3A, from below.

In accordance with FIG. 3A, the lower side of the grinding wheel 18 of the grinding tool 17 comprises a grinding layer 19' having a markedly profiled surface, wherein the embodiment shown has a plurality of radially extending, protruding ribs (see FIG. 4) The grinding tool 17 is vertically lowered to the treatment plane B and then guided from various radial directions over the surface of the bristle field 20, wherein the grinding surface 19' effects rounding of the free ends of the bristles 12 and the marked structure of the grinding surface 19' exert radial external mechanical striking forces on the bristles 12 to split the splittable bristles of the bristle stock at their free ends. Means are provided for guiding the grinding wheel over the bristle field 20 in eight directions, each displaced from another by 45°. Treatment and splitting of the bristles can be supported by varying the tool speeds or frequencies during treatment The grinding surface 19' can also be segmented such that certain sections primarily effect rounding of the bristle ends, whereas other sections exercise the mechanical striking forces.

Figure 5A:
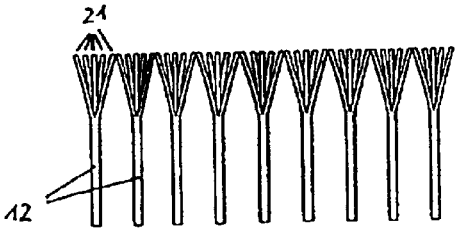
FIG. 5A shows a schematic illustration of a bristle stock from the side.
Figure 6A:
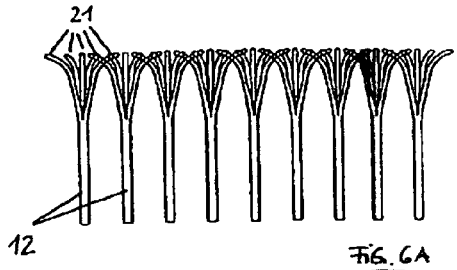
FIG. 6A shows the bristle stock according to FIG. 5A after use.
Figure 5B:
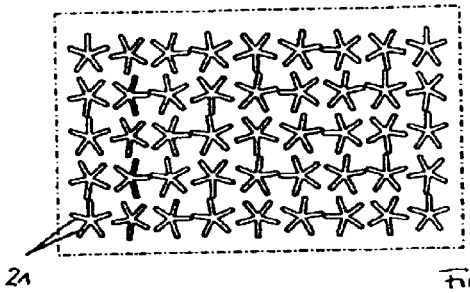
FIG. 5B shows a schematic illustration of the bristle stock from the top.
Figure 6B:
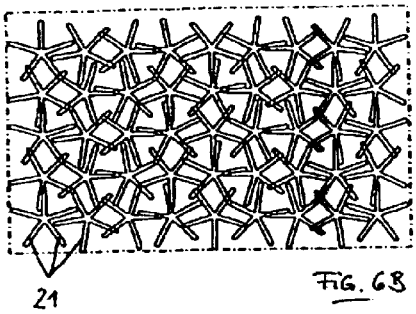
FIG. 6B shows the bristle stock according to FIG. 5B after use.

FIGS. 5A and 5B show a schematic representation of a bristle stock, wherein each of the free upper ends of the bristles 12 are split to a predetermined, height into five fingers 21. In the embodiment shown in FIGS. 5A and 5B, all bristles are split at their upper ends, wherein the fingers 21 of neighboring bristles do not overlap or overlap only slightly. If a brush comprising the bristle stock shown in FIGS. 5A and 5B has been used for a certain time, the ends of the fingers are spread by the brushing forces effective during use, such that interactions can occur between the fingers of neighboring brushes 12, as shown in FIGS. 6A and 6B. To prevent such interactions, the embodiment in accordance with FIGS. 7A and 7B comprises at least one non-splittable bristle 22 between the splittable bristles 12 which further separates the splittable bristles 12 from each other. The non-splittable bristles 22 disposed between the splittable bristles 12 also have a lateral supporting effect on the splittable bristles 12. After a brush with such a bristle stock is used, the fingers 21 of the split bristles 12 spread laterally. However, the interposed unsplit bristles 22 prevent engagement between the fingers of neighboring split bristles 12 to maintain the desired fine character of the brush surface.

Figure 7A:
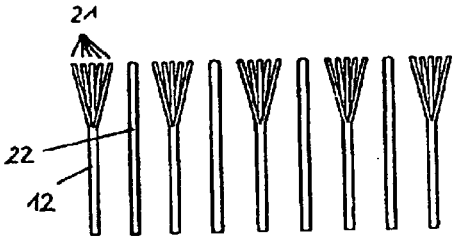
FIG. 7A shows a schematic illustration of a further bristle stock from the side.
Figure 8A:
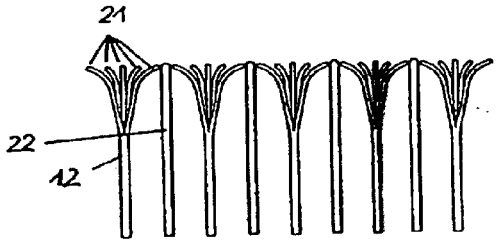
FIG. 8A shows the bristle stock according to FIG. 7A after use.
Figure 7B:
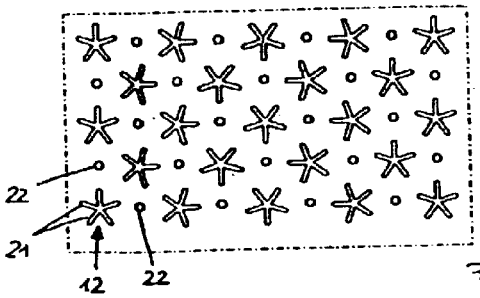
FIG. 7B shows a schematic illustration of the further bristle stock from the top.
Figure 8B:
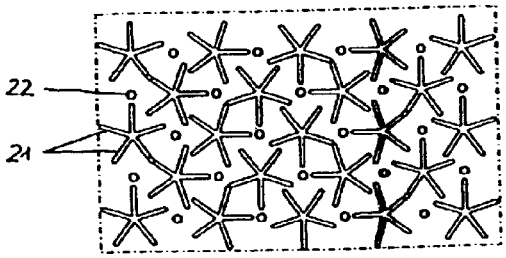
FIG. 8B shows the bristle stock according to FIG. 7B after use.
Figure 9:
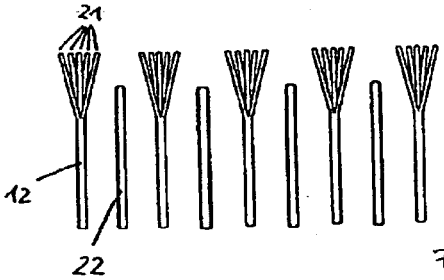
FIG. 9 shows a modification of the bristle stock according to FIG. 7A.
Figure 10:
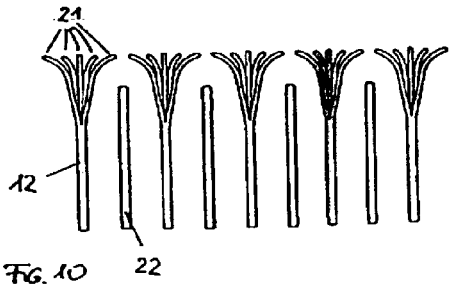
FIG. 10 shows the bristle stock according to FIG. 9 after use.

In the embodiment shown in FIGS. 7A and 7B, the upper ends of the split bristles 12 and the upper ends of the unsplit bristles 22 are disposed in essentially the same plane or envelope surface. FIG. 9 shows a modification, wherein the unsplit bristles 22 extend only to approximately half the height of the fingers 21 of the split bristles 22, i.e. their upper ends are disposed in a plane below the plane or envelope surface of the free ends of the split bristles 12. In this manner, the brushing effect depends on the applied brushing strength. When the brushing force is small, the fine fingers of the split bristles are preferably active, whereas the generally harder ends of the interposed unsplit bristles 22 are also active with increased brushing force. The fingers 21 of the split bristles 12 spread apart during use but do not engage one another due to the interposed unsplit bristles 22 and the associated mutual separation (FIG. 10).

What is claimed is:

1. A method of mechanically splitting bristles, the method comprising the step of:

providing a plurality of bristles; and applying mechanical forces to the bristles from a plurality of directions relative to a longitudinal axis of the bristles using at least one blunt tool, to split at least some of the bristles into a plurality of partial cross-sections along at least part of their lengths.

2. The method of claim 1, wherein said blunt tool strikes the bristles.

3. The method of claim 1, wherein said mechanical forces are applied intermittently.

4. The method of claim 1, wherein said mechanical forces are applied substantially radially with respect to the longitudinal axes of the bristles.

5. The method of claim 1, wherein a position of said tool is changed relative to the bristles being treated.

6. The method of claim 1, wherein the bristles are oriented substantially parallel to one another.

7. The method of claim 1, wherein said tool is adjusted to different operating positions about the longitudinal axes of the bristles being treated.

8. The method of claim 1, wherein the bristles are rotated about an axis extending parallel to their longitudinal axes.

9. The method of claim 1, wherein said mechanical forces are applied in different axial sections of the bristles.

10. The method of claim 1, wherein said at least one blunt tool includes several tools having different orientations relative to the bristles being treated.

11. The method of claim 1, wherein the bristles are formed from a first and a second co-extruded polymer in a geometrically regular arrangement with bordering layers, extending essentially in an axial direction, in which reduced secondary binding forces are active.

12. The method of claim 11, wherein the bristle are formed from a monofilament comprising a matrix of polymer determining physical and chemical properties of the bristle, wherein the second polymer is embedded in the matrix as layers.

13. The method of claim 1, further comprising additional treatment of ends of the bristles, wherein said additional treatment is at least one of mechanical, thermal, and rounding.

14. The method of claim 13, wherein said additional treatment is carried out simultaneously with application of said mechanical forces.

15. The method of claim 13, wherein said additional treatment and said application of mechanical forces are effected with said at least one blunt tool.

* * * * *